US006129355A

United States Patent [19]

Hahn et al.

[11] Patent Number: 6,129,355

[45] Date of Patent: Oct. 10, 2000

[54] REEL DEVICE FOR GAMING MACHINES

[75] Inventors: Brian Lee Hahn, Chicago; Herbert H. Hausmann, Prairie View; Wayne H. Rothschild, Northbrook; James M. Rasmussen, Chicago; Samuel P. Amdahl, Wheeling, all of Ill.

[73] Assignee: WMS Gaming Inc., Chicago, Ill.

[21] Appl. No.: 08/947,409

[22] Filed: Oct. 8, 1997

[51] Int. Cl.[7] ..... A63F 5/04

[52] U.S. Cl. ..... 273/142 R; 273/138.1

[58] Field of Search ..... 273/138.1, 142 R, 273/143 R, 142 H, 142 J, 142 JD

[56] References Cited

U.S. PATENT DOCUMENTS

| | | | |
|---|---|---|---|
| 747,250 | 12/1903 | Smith . | |
| 851,189 | 4/1907 | Wagner . | |
| 1,180,695 | 4/1916 | Carlson . | |
| 2,622,215 | 12/1952 | Piekarski et al. . | |
| 2,687,890 | 8/1954 | Hedin | 273/142 R |
| 4,410,178 | 10/1983 | Partidge . | |
| 4,621,815 | 11/1986 | Yamamoto . | |
| 4,637,611 | 1/1987 | Hamada . | |
| 4,660,833 | 4/1987 | Dickinson et al. . | |
| 4,711,452 | 12/1987 | Dickinson et al. . | |
| 4,741,532 | 5/1988 | Okada . | |
| 4,911,449 | 3/1990 | Dickinson et al. . | |
| 4,912,389 | 3/1990 | Eguchi . | |
| 5,058,893 | 10/1991 | Dickinson et al. . | |
| 5,388,829 | 2/1995 | Holmes . | |

FOREIGN PATENT DOCUMENTS

| | | |
|---|---|---|
| 338722 | 11/1903 | France . |
| 337895 | 10/1904 | France . |
| 751476 | 6/1932 | France . |
| 584207 | 9/1933 | Germany . |
| 2838339 | 3/1980 | Germany . |
| 587679 | 1/1959 | Italy . |
| 171415 | 11/1934 | Switzerland . |
| 473277 | 10/1937 | United Kingdom . |

OTHER PUBLICATIONS

Russian Inventor's Certificate No. 898155, V.A. Tsapovich Flexible Coupling, V.A. Tsapovich.

*Primary Examiner*—Valencia Martin-Wallace
*Assistant Examiner*—John M. Hotaling, II
*Attorney, Agent, or Firm*—Piper Marbury Rudnick & Wolfe

[57] ABSTRACT

A reel assembly for a gaming machine includes a reel structure adapted for rotation about a motor output shaft. A drive lever is adapted for connecting the output shaft to the reel structure at a point radially spaced from the output shaft to provide a resilient, radially extending coupling between the output shaft and the reel structure. The drive lever is of sufficient length to allow flexing thereof and is capable of storing energy at the start of rotation to cause the reel structure to be suddenly rotated by the restored energy. The drive lever has a terminal end mounted to said reel structure in a manner that prevents tangential movement of said terminal end relative to said reel structure. Thus, the drive lever flexes when the output shaft starts to rotate until the inertia of the reel structure is overcome, whereupon the drive lever returns to its initial shape and causes rotation of the reel structure, thereby reducing the start-up torque and power required to overcome the inertia of the reel structure.

23 Claims, 3 Drawing Sheets

REEL DEVICE FOR GAMING MACHINES

FIELD OF THE INVENTION

The present invention relates generally to gaming machines with reels driven by motors, and more particularly, to an improved reel drive mechanism which facilitates starting and stopping of the reels.

BACKGROUND OF THE INVENTION

As is known in the art, reel-type gaming machines typically include a number of adjacent reels each having a plurality of symbols such as fruit provided on the outer periphery of the reels. The reels are simultaneously caused to start rotation by pulling a handle or pushing a button after inserting a given number of coins or tokens into a coin slot. After the start of rotation, the individual reels are successively brought to a stop after the lapse of random time periods determined by a micro-processor-based control system. When all the reels are stopped, a symbol from each reel is in alignment with a pay line displayed on a window. If the symbols aligned with the pay line are a winning combination, a number of coins corresponding to the probability of occurrence of that combination are paid out from a pay-out slot.

Typically, each reel is provided with an individual stepping motor which drives the reel. Thus, the speed of rotation can be controlled by adjusting the pulse rate and can be kept at a standard value under normal operating conditions. Also, the position of the reel (i.e. the angle of rotation) can be easily controlled in accordance with the total number of pulses supplied to the motor. The control system supplies the pulses to the motor to control the operation and position of the reels.

However, one disadvantage of utilizing stepper motors is unsatisfactory starting and stopping operation. Typically, the inertia of the reel presents a significant load when starting from a standstill or stopping during full rotation, which can result in a jerky and irregular start or stop. There is also a risk that the motor may completely stall, lose positional control, or otherwise operate improperly. The start-up operation can be improved by a reduction in the pulse rate from the standard value over an initial short period. This results in a slow motor output speed at which the motor will start, which then must be accelerated by increasing the pulse rate to the standard value. Even with this ramping up of pulse rate, the startup operation of the motor is somewhat hesitant and causes stress which can lead to undesirable performance of the motor. To avoid this problem, it is desirable to provide a smooth start and stop such as that obtained by the gradual release of a spring when using a purely mechanical drive.

Attempts have been made to provide such a spring action to overcome the inertia of the reel and impart an impulsive start-up movement to the reel. For example, in one such device, an output shaft of the motor is connected to the reel through two O-rings of elastomeric material. The O-rings are fitted on opposing portions of a pin extending transversely through the motor shaft, and engage the sides of an opening in a boss forming part of the reel structure. Thus, the driving torque is transmitted to the reel through the O-rings, which provide a degree of resilience for overcoming the inertia of the reel, thereby providing a quicker, more responsive start to the rotation of the reel. In other words, the resilient O-rings are an attempt to provide a smooth acceleration from the start-up speed to the standard operating speed of the motor.

Although the O-ring type reel mechanisms are a step toward improving start-up operation of the motors, there remains a need for further improvement by providing a more responsive spring action to overcome the inertia of the reel. As will be appreciated, the effect of the O-rings is limited because the spring action can only be imparted to an isolated region in the central hub of the reel. This leads to high stress and increased maintenance costs. It is therefore desirable to provide a mechanism which redistributes the application of the spring force away from the center of the reel structure to facilitate the spring action imparted on the reel.

SUMMARY OF THE INVENTION

In view of the above, and in accordance with one aspect of the present invention, there is provided a reel assembly for a gaming machine including a reel structure adapted for rotation about a motor output shaft. A drive lever is adapted for connecting the output shaft to the reel structure at a point radially spaced from the output shaft to provide a resilient, radially extending coupling between the output shaft and the reel structure. The drive lever is of sufficient length to allow flexing thereof and is capable of storing energy at the start of rotation to cause the reel structure to be smoothly rotated by the stored energy. The drive lever also has a terminal end mounted to said reel structure in a manner that prevents tangential movement of said terminal end relative to said reel structure. Thus, the drive lever flexes when the output shaft starts to rotate until the inertia of the reel structure is overcome, whereupon the drive lever returns to its initial shape and causes smooth rotation of the reel structure, thereby reducing the start-up torque and power required to overcome the inertia of the reel structure.

In a preferred embodiment of the invention, the drive lever is configured as a straight wire extending through a transverse hole in the drive shaft of the motor. The wire can be round or flat, or it can be configured with any other suitable cross-section. The wire can be made of sheet metal, stainless steel, or other suitable material capable of absorbing and imparting energy upon rotation of the motor shaft. The wire has opposing end portions extending radially in opposite directions from the drive shaft, and each end portion has a terminal end connected to a corresponding driven member of the reel structure. Preferably, the terminal ends of the wire are coupled to a pair of spaced apart clips in the form of snap-like open channels formed on radial spokes of the reel frame structure. Thus, the terminal ends of the wire are allowed to move slightly in a longitudinal direction in the channels to accommodate flexure of the wire. When the motor starts up, the wire flexes to provide a spring action which overcomes the inertia of the reel and imparts a start-up movement to the reel.

The present invention provides significant advantages over other devices such as O-rings for imparting a spring action on a reel structure. The use of a wire which flexes provides greater spring action and is more efficient due to the redistribution of the spring force away from the center of the reel. The snap-in configuration of the reel structure also facilitates assembly and disassembly so that the reel can be easily removed and replaced.

The present invention, together with further objects and advantages, will be best understood by reference to the following detailed description taken in conjunction with the accompanying drawings.

DETAILED DESCRIPTION OF THE PREFERRED EMBODIMENT(S)

Figure 1:
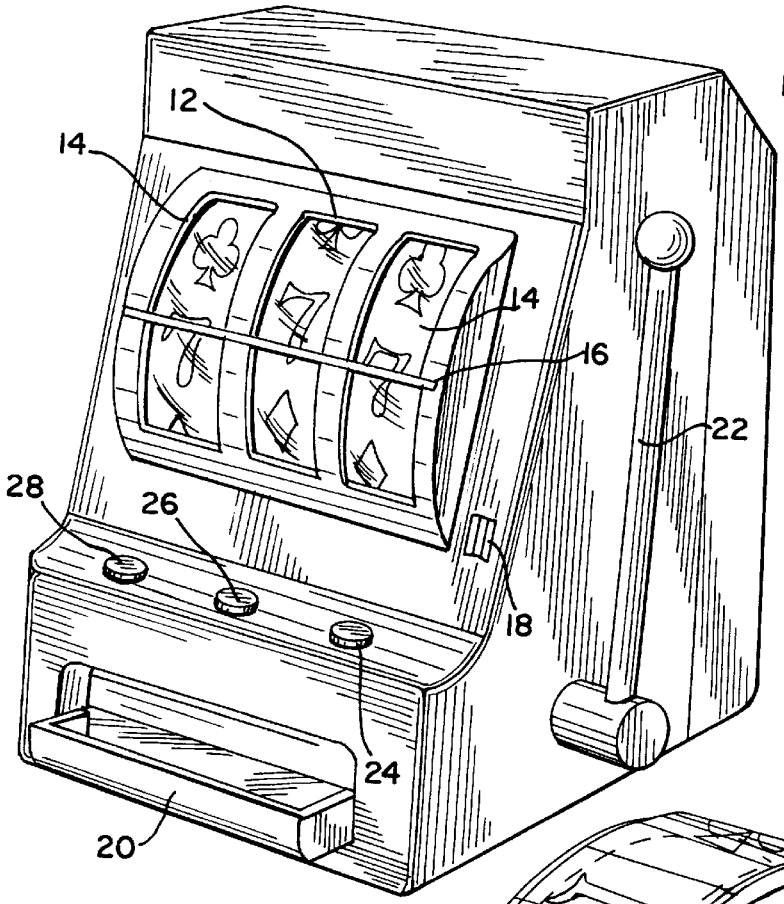
FIG. 1 is a perspective view of a reel-type gaming machine housing several reel assemblies.

While the present invention is susceptible of embodiment in various forms, there is shown in the drawings and will hereinafter be described a preferred embodiment of the invention with the understanding that the present disclosure is to be considered as setting forth exemplifications of the invention which are not intended to limit the invention to the specific embodiment illustrated.

Referring to FIG. 1, there is illustrated a slot machine suitable for use with the present invention. The slot machine is provided in a cabinet 10 having three viewing windows 12 provided therein through which the player may observe the symbols on the reels. Typically, there are three reels, each of which has a reel strip 14 on which symbols are printed. The reel strips 14 are usually a piece of plastic imprinted with symbols such as fruit, depending on the particular game to be played. The windows 12 have marked thereon at least one payline 16 which indicates the position with which the symbols must be aligned in order to constitute a winning combination.

To activate the game, coins or tokens are placed in slot 18, and winning combinations are paid off through a bottom dispensing slot or trough 20. Play of the game is controlled by various player switches which may be conveniently mounted on the cabinet 10. Traditional slot machines include a handle switch or pull lever 22 for initiating operation of the game, although modern machines also include push button switches such as switch 24 for players who prefer to use such switches rather than handles. Modern machines also include additional player operated switches, usually for the purpose of controlling the number of coins or tokens to be bet on each spin of the reels, or for initiating a pay-out when a player wishes to cash in credits rather than continuing to play. Two of these switches are indicated at 26 and 28. In the illustrated embodiment, switches 24, 26 and 28 are positioned directly beneath a corresponding reel strip 14.

Figure 2:
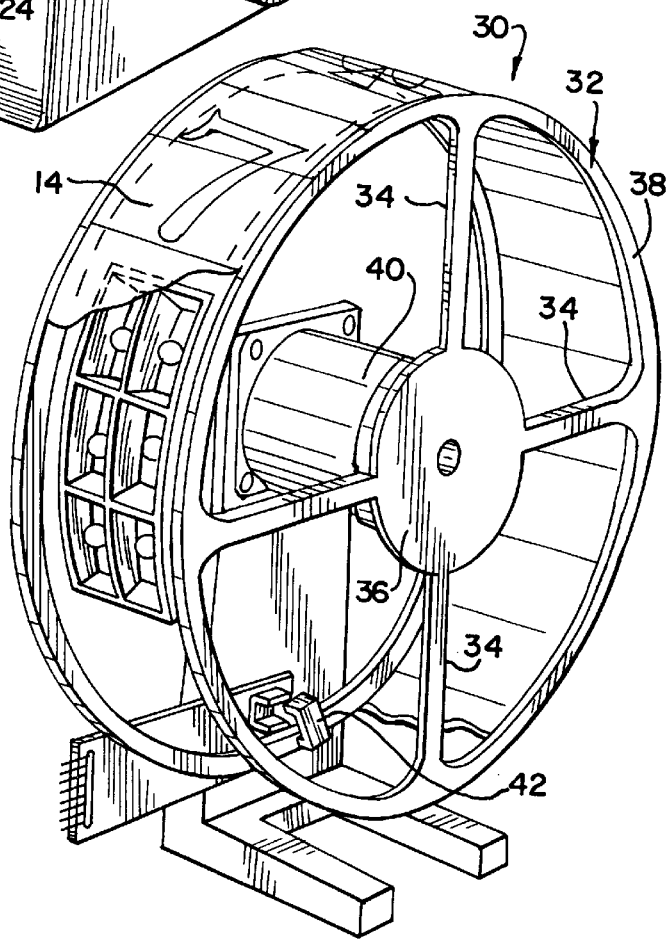
FIG. 2 is a perspective view of a reel assembly according to the present invention.

As shown in FIG. 2, a reel assembly 30 consists generally of a reel structure 32 on which the reel strip 14 is secured for rotation. The reel structure 32 is configured with a plurality of radial spokes 34 extending radially from a central hub 36 to an annular frame member 38 which defines the outer circumference of the reel structure 32. Rotation of the reel structure 32 is controlled by a stepper motor 40 which is operated by the appropriate driver circuitry under the control of the game micro-processor system. The home or zero position of the reel is determined using a flag 42 or similar structure attached to the reel.

Figure 4:
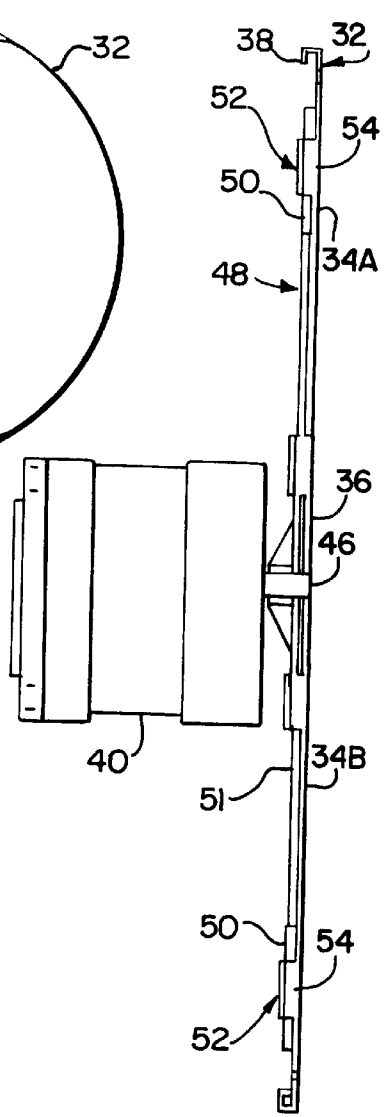
FIG. 4 is a cross-sectional view of the reel assembly taken along the line 4—4 in FIG. 3.
Figure 3:
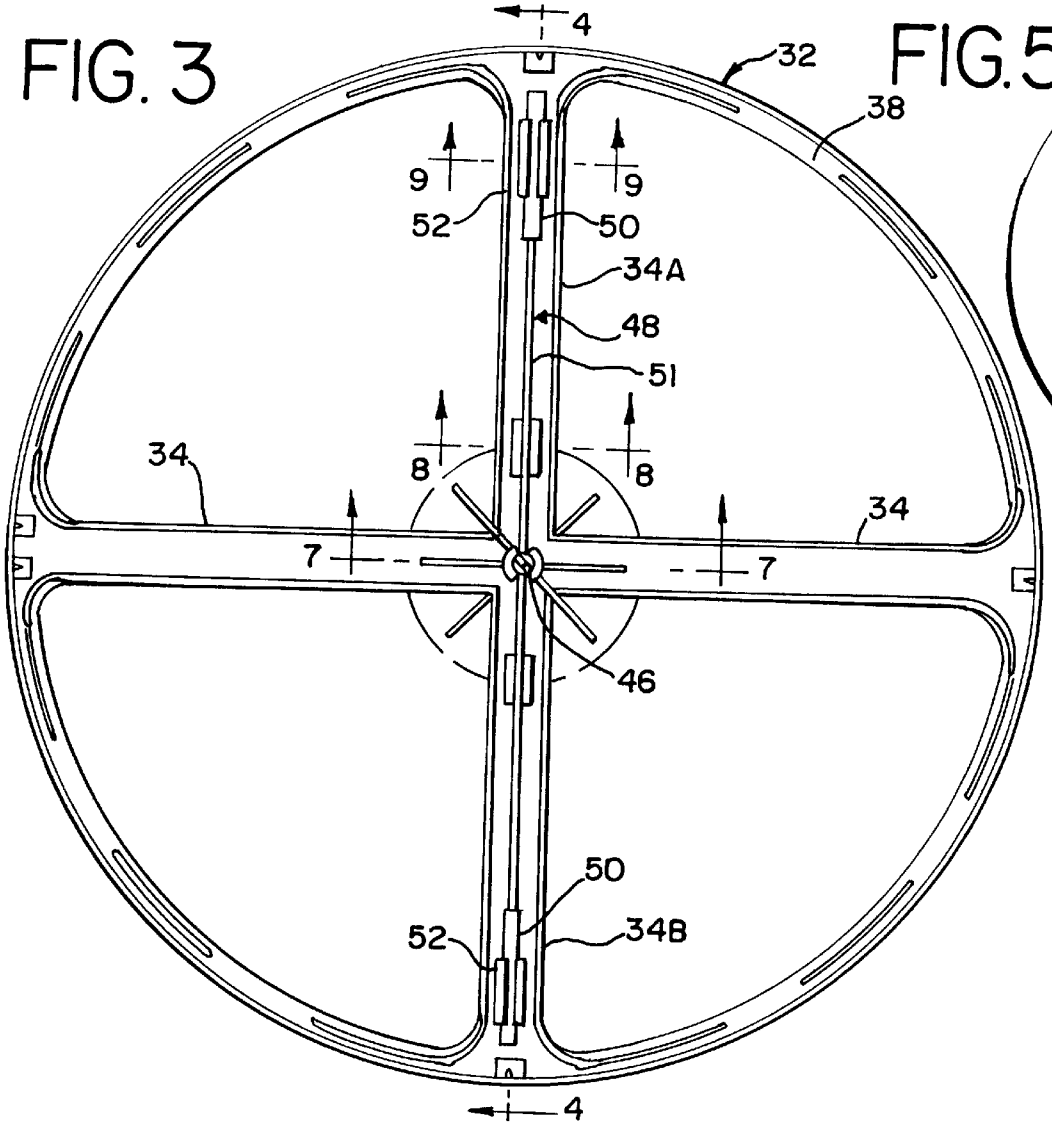
FIG. 3 is a side view of the reel assembly shown in FIG. 2 with various features removed for clarity.
Figure 6:
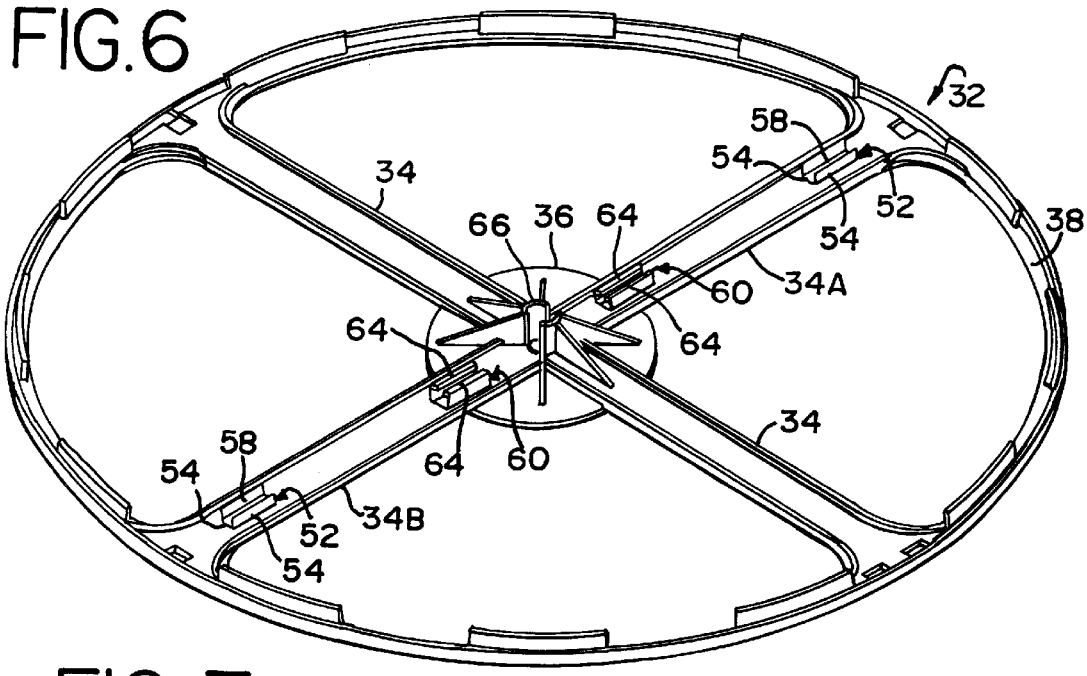
FIG. 6 is a perspective view of the reel structure of the present invention.

Referring to FIGS. 3 and 4, the reel structure 32 is coupled to an output drive shaft 46 of the motor 40 by a straight spring member 48 which acts as a resilient drive lever. The spring member 48 extends through a transverse hole in the output shaft 46 and is positioned generally aligned with radial spokes 34A and 34B of the reel structure 32. Preferably, the spring member 48 is made of stainless steel, although other materials capable of storing energy and imparting a spring action are within the scope of the present invention. As will be appreciated, it is desirable to balance the strength and mass of the material with its resiliency or flexure characteristics.

Figure 9:
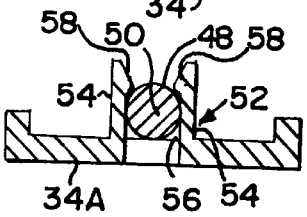
FIG. 9 is a partial cross-sectional view of a clip taken along the line 9—9 in FIG. 3.

To transfer the rotational force of the motor output shaft 46 to the reel structure 32, terminal end portions 50 of the spring member 48 are attached to the radial spokes 34A and 34B. Preferably, the terminal end portions 50 have a greater diameter than the middle portion 51 of the spring member 48. To act as drive blocks for rotating the reel structure 32, the spokes 34A and 34B are provided with relatively low profile clips 52 that receive the spring member 48. The clips 52 are preferably made of plastic and are integral with reel structure 32. As best shown in FIG. 9, the clips 52 preferably have side walls 54 through which the force of the spring member 48 is transmitted in a generally tangential direction. The side walls 54 define channels 56 which allow the terminal ends 50 of the spring member 48 to move slightly in a longitudinal direction to accommodate flexure of the spring member. The side walls 54 are also provided with inwardly extending tabs 58 which create a snap-like feature to facilitate quick assembly and disassembly of the reel structure 32 from the spring member 48.

Figure 5:
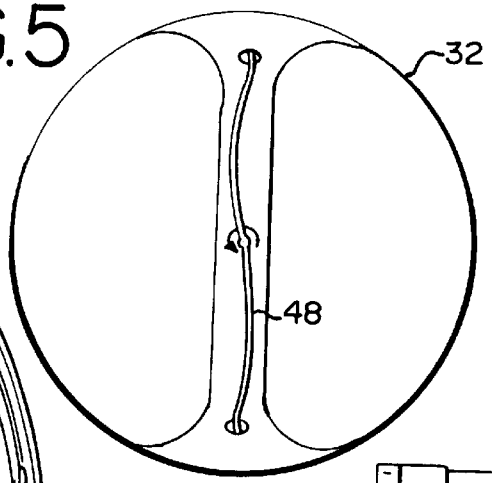
FIG. 5 is a schematic representation of the spring action imparted by a wire on the reel structure.
Figure 7:
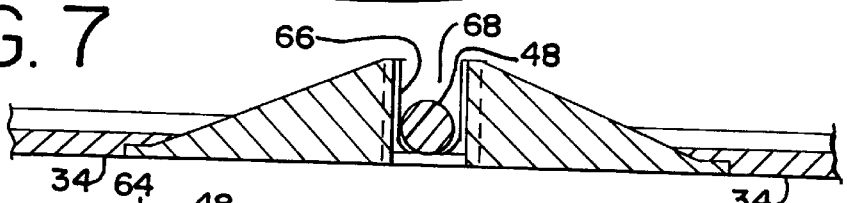
FIG. 7 is a partial cross-sectional view of a hub of the reel structure taken along the line 7—7 in FIG. 3, with the output shaft of the motor removed for clarity.
Figure 8:
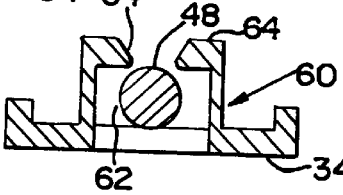
FIG. 8 is a partial cross-sectional view of a guide channel taken along the line 8—8 in FIG. 3.
Figure 10:
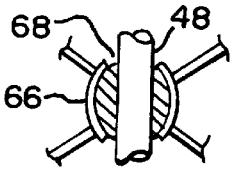
FIG. 10 is a fragmentary top view of the hub shown in FIG. 7.

As shown in FIG. 8, a pair of intermediate channel members 60 are formed on the spokes 34A and 34B for receiving central portions the spring member 48. The channel members 60 each define a channel 62 and inwardly extending flanges 64. The flanges 64 provide a snap-like feature to facilitate assembly and disassembly, and the channel 62 is wider than the diameter of the spring member 48 to allow flexing of the spring member during startup operation of the motor 40. Similarly, FIGS. 7 and 10 illustrate a central boss 66 formed on the reel structure 32 with a channel 68 which is wider than the diameter of the spring member 48. Thus, rather than transmitting the torque of the motor shaft 46 directly to the central boss 66 to rotate the reel structure 32, the force of the rotating shaft 46 causes the spring member 48 to flex into a slight S shape as shown in broken lines in FIG. 3 and schematically in FIG. 5. The spring member 48 therefore absorbs startup shock loads required to overcome the reel inertia, and upon return to its normal straight shape, transmits the stored energy through the terminal clips 52, thereby quickly and efficiently rotating the reel structure 32. This reduces the start-up and stopping torque, and therefore start-up and stopping power required by the motor, which allows smaller motors to be used and prevents stalling.

It will be appreciated that the use of stored energy is maximized by allowing the hub 36 to freely rotate about the motor shaft 46 and distributing the spring action radially outwardly, thereby creating a greater moment arm for absorbing and transmitting load from the motor to the reel structure. This redistribution of spring action can be accomplished by attaching the terminal ends of the spring member to any portion of a reel structure that is remote from the central boss, including intermediate or outer circumferential rims.

Figure 11:
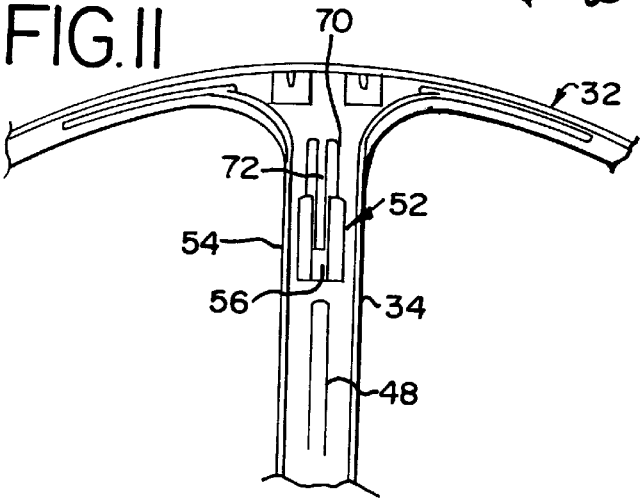
FIG. 11 is a fragmentary top view of the reel structure illustrating an alternative embodiment of a clip having a snap-out feature.
Figure 12:
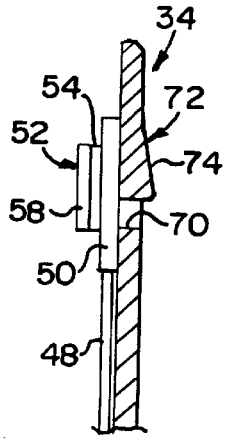
FIG. 12 is a partial cross-sectional view of the reel structure shown in FIG. 11.

FIGS. 11 and 12 illustrate an alternative embodiment of the clips 52. As shown, the spokes 34A and 34B each have a longitudinal aperture 70 formed therein which underlies the associated clip 52. A resilient "punch-out" tab 72 extends within and along the aperture for operable engagement with the associated end portion 50 of the spring member 48. As shown in FIG. 12, the tab 72 is integrally formed with the associated spoke 34 and has an underside 74 that extends beyond the plane of the reel structure 32. Thus, an operator can press the tab 72 with a finger and force the end portion 50 of the spring member 48 out of engagement with the clip 52, thereby facilitating quick assembly and disassembly of the reel structure 32 from the spring member 48.

To transfer the rotational force of the motor output shaft 46 to the reel structure 32, terminal end portions 50 of the spring member 48 are attached to the radial spokes 34A and 34B. Preferably, the terminal end portions 50 have a greater diameter than the middle portion 51 of the spring member 48. To act as drive blocks for rotating the reel structure 32, the spokes 34A and 34B are provided with relatively low profile clips 52 that receive the spring member 48. The clips 52 are preferably made of plastic and are integral with reel structure 32. As best shown in FIG. 9, the clips 52 preferably have side walls 54 through which the force of the spring member 48 is transmitted in a generally tangential direction. The side walls 54 define channels 56 which allow the terminal ends 50 of the spring member 48 to move slightly in a longitudinal direction to accommodate flexure of the spring member. The side walls 54 are also provided with inwardly extending tabs 58 which create a snap-like feature to facilitate quick assembly and disassembly of the reel structure 32 from the spring member 48.

Thus, an improved reel assembly for a gaming machine is provided which causes a smooth start-up and stopping rotation of a reel structure. When the motor starts up, the spring member flexes to provide a spring action which overcomes the inertia of the reel and imparts a smooth start-up movement to the reel structure. When the motor stops, the spring member again flexes to provide a spring action which absorbs the inertia of the reel to more accurately control the stopping position of the reel. The present invention also provides a snap-in reel which can be easily removed and replaced if desired.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiments illustrated. The disclosure is intended to cover by the appended claims all such modifications as fall within the scope of the claims.

What is claimed is:

1. A reel assembly for a gaming machine, comprising:

a reel structure adapted for rotation about a motor output shaft, said reel structure including a central hub and an annular frame member with a radial spoke extending therebetween; and a drive lever attached to the radial spoke of the reel structure and connected to the output shaft to provide a resilient, radially extending coupling between the output shaft and the reel structure, said drive lever being of sufficient length to allow flexing thereof and storing energy at the start of rotation to cause said reel structure to be suddenly rotated by the restored energy, said lever having a terminal end mounted to said reel structure in a manner that prevents tangential movement of said terminal end relative to said reel structure;

whereby the drive lever flexes when the output shaft starts to rotate until the inertia of the reel structure is overcome, whereupon the drive lever returns to its initial shape and causes rotation of the reel structure, thereby reducing the start-up torque and power required to overcome the inertia of the reel structure.

2. The reel assembly of claim 1 wherein the drive lever is straight.

3. The reel assembly of claim 2 wherein the drive lever is made of stainless steel.

4. The reel assembly of claim 1 wherein the drive lever comprises a one-piece straight wire extending through a transverse hole in the output shaft.

5. The reel assembly of claim 1 wherein the reel frame structure comprises an annular frame member having a central axis in general alignment with a central axis of the output shaft.

6. The reel assembly of claim 5 wherein the annular frame member defines the outer circumference of the reel structure.

7. The reel assembly of claim 1 wherein the terminal end of the drive lever is releasably attached to the reel structure.

8. The reel assembly of claim 7 further comprising a clip formed on the reel structure and having an open channel adapted to receive the terminal end of the drive lever in a snap-like manner, wherein said terminal end is allowed to move slightly in a longitudinal direction in the channel to accommodate flexure of the drive lever.

9. A reel assembly for a gaming machine, comprising:

a reel structure adapted for rotation about a motor output shaft;

a drive lever connecting the output shaft to the reel structure at a point radially spaced from said output shaft to provide a resilient, radially extending coupling between the output shaft and the reel structure, said drive lever being of sufficient length to allow flexing thereof and storing energy at the start of rotation to cause said reel structure to be suddenly rotated by the restored energy, said lever having a terminal end; and said point radially spaced from said output shaft including a clip formed on the reel structure having an open channel adapted to receive the terminal end of the drive lever in a releasable snap-like manner, wherein said terminal end is allowed to move slightly in a longitudinal direction in the channel to accommodate flexure of the drive lever but is prevented from tangential movement relative to said reel structure;

whereby the drive lever flexes when the output shaft starts to rotate until the inertia of the reel structure is overcome, whereupon the drive lever returns to its initial shape and causes rotation of the reel structure, thereby reducing the start-up torque and power required to overcome the inertia of the reel structure.

10. The reel assembly of claim 9 wherein said channel is defined by side walls which operably engage the terminal end of the drive lever to prevent movement thereof in a tangential direction relative to the reel structure, thereby acting as a drive block for rotating the reel structure.

11. The reel assembly of claim 9 further comprising a snap member configured to operably engage the drive lever to facilitate removal of the drive lever from the open channel.

12. The reel assembly of claim 11 further comprising an aperture formed in the reel structure underlying the channel, wherein the snap member comprises a resilient member extending axially within the aperture and past a plane defined by the reel structure, whereby the snap member can be pressed toward the channel to snap the drive lever out of the channel.

13. A reel assembly for a gaming machine, comprising:

a motor having an output drive shaft;

a reel structure including an annular frame member having a central axis in general alignment with a central axis of the output drive shaft;

a generally straight, resilient drive lever extending radially in opposite directions from said output drive shaft and having opposing terminal ends;

a clip formed on the reel structure and having an open channel adapted to releasably receive a terminal end of the drive lever in a snap-like manner and in a manner that prevents tangential movement of the terminal end relative to said reel structure; and said drive lever storing energy with the start of said motor to cause said reel structure to be suddenly rotated by the restored energy;

whereby the drive lever flexes when the output drive shaft starts to rotate until the inertia of the reel structure is overcome, whereupon the drive lever returns to its initial shape and causes rotation of the reel structure, thereby reducing the start-up torque and start-up power of the motor required to overcome the inertia of the reel structure.

14. The reel assembly of claim 13 wherein the drive lever is a straight wire made of stainless steel.

15. The reel assembly of claim 14 wherein the wire extends through a transverse hole in the output drive shaft.

16. The reel assembly of claim 13 wherein the annular frame member defines the outer circumference of the reel structure.

17. The reel assembly of claim 13 wherein said channel is defined by side walls which operably engage the terminal end of the drive lever to prevent movement thereof in a tangential direction relative to the driven member, thereby acting as a drive block for rotating the reel structure.

18. The reel assembly of claim 17 further comprising a snap member configured to operably engage the drive lever to facilitate removal of the drive lever from the open channel.

19. The reel assembly of claim 14 further comprising an aperture formed in the reel structure underlying the channel, wherein the snap member comprises a resilient member extending axially within the aperture and past a plane defined by the reel structure, whereby the snap member can be pressed toward the channel to snap the drive lever out of the channel.

20. A reel assembly for a gaming machine, comprising:

a motor having an output drive shaft;

a reel structure including an annular frame member having a central axis in general alignment with a central axis of the output drive shaft, said annular frame member defining the outer circumference of the reel structure;

said reel structure also including clips, each of which having an open channel; and a straight, resilient drive member extending radially in opposite directions from said output drive shaft and having opposing terminal ends releasably received in a snap-like manner in the open channels of the clips in a manner that prevents movement of said terminal ends relative to said reel structure, said drive member storing energy with the start of said motor to cause said reel structure to be suddenly rotated by the restored energy;

whereby the drive member flexes when the output drive shaft starts to rotate until the inertia of the reel structure is overcome, whereupon the drive member returns to its initial shape and causes rotation of the reel structure, thereby reducing the start-up torque and start-up power of the motor required to overcome the inertia of the reel structure.

21. The reel assembly of claim 20 wherein said channel is defined by side walls which operably engage the terminal end of the drive member to prevent movement thereof in a tangential direction relative to the driven member, thereby acting as a drive block for rotating the reel structure.

22. The reel assembly of claim 20 further comprising a snap member configured to operably engage the drive lever to facilitate removal of the drive lever from the open channel.

23. The reel assembly of claim 22 further comprising an aperture formed in the reel structure underlying the channel, wherein the snap member comprises a resilient member extending axially within the aperture and past a plane defined by the reel structure, whereby the snap member can be pressed toward the channel to snap the drive lever out of the channel.

* * * * *